US005379904A

United States Patent [19]

Brown

[11] Patent Number: 5,379,904

[45] Date of Patent: Jan. 10, 1995

[54] RESTRAINT SYSTEM FOR A SHEET SHIPPING RACK

[75] Inventor: William J. Brown, Lower Burrell, Pa.

[73] Assignee: PPG Industries, Inc., Pittsburgh, Pa.

[21] Appl. No.: 39,717

[22] Filed: Mar. 29, 1993

[51] Int. Cl.[6] ..... A47F 7/00

[52] U.S. Cl. ..... 211/41; 211/175

[58] Field of Search ..... 211/41, 175, 49.1; 206/451

[56] References Cited

U.S. PATENT DOCUMENTS

| | | | |
|---|---|---|---|
| 2,815,861 | 12/1957 | Schodorf, Sr. | 211/41 X |
| 2,839,198 | 6/1958 | Lefevre | 211/41 |
| 3,424,487 | 1/1969 | Pector et al. | 211/41 X |
| 3,878,942 | 4/1975 | Hansen et al. | 211/41 X |

*Primary Examiner*—Ramon O. Ramirez
*Assistant Examiner*—Sarah L. Purol
*Attorney, Agent, or Firm*—Donald C. Lepiane

[57] ABSTRACT

A sheet restraint for a sheet shipping rack includes a first elongated tube rotatably mounted on a second elongated tube. The second tube has U-shaped member secured to each end to capture the first tube on the second tube while allowing the first member to rotate relative to the second member. A resilient elongated sheet engaging member is secured to the first member. A pair of spaced pins are mounted on the first member and engageable with the U-shaped member to limit rotation of the first member about the second member so that the rotational path of the sheet engaging member and first tube is limited. The engaging members on the second tube are slideable mounted to spaced standards at the front of a rack. In this manner the front restraint moves toward the base into engagement with the outermost sheet of a stack of sheets on the rack to maintain the sheets as an integral pack. During shipment, the movement of the sheets and rack by the transportation forces and any space resulting from such movement is taken up by the front restraints as it moves downwardly toward the base.

To unload the sheets from the rack the front restraint is urged upward away from the base and removable from the standards at the front of the rack.

20 Claims, 5 Drawing Sheets

RESTRAINT SYSTEM FOR A SHEET SHIPPING RACK

FIELD OF THE INVENTION

This invention relates to a restraint system for a sheet shipping rack and, more particularly, to a front restraint that is self alignable and adjustable to maintain loose glass sheets as a unitized pack during shipment.

DESCRIPTION OF THE AVAILABLE SHEET RESTRAINT SYSTEM

Sheet restraint systems presently available for securing sheets in position during shipment are adjusted at the time of loading the sheets to applying sufficient force to unitize the sheets and to maintain the sheets as a unitized stack during shipment. Although the presently available restraint systems are acceptable, there are limitations. For example, during shipment, the transportation forces cause the sheets to vibrate. This vibration can cause the sheets to shift making the force insufficient to maintain them as a unitized pack.

It would be advantageous, therefore, to provide a sheet restraint system that is self adjusting to maintain the sheets as a unitized pack during shipment.

SUMMARY OF THE INVENTION

This invention relates to a front restraint system for securing sheets in a rack as a unitized pack. The front restraint system includes a first elongated member mounted on a second elongated member so that the longitudinal axis of the first and second members are coincidental and the first member rotates about the axis relative to the second member. An engaging member is mounted on each end of the second member to capture the first member on the second member and to movably secure the second member on a rack spaced from the backwall. The first member has a sheet engaging surface to prevent marring of the outermost sheet engaged by the first member.

The invention further relates to a shipping rack using the front restraint system of the invention. The rack includes a base, a backwall and a pair of standards mounted on the base spaced from each other and the backwall. The engaging members of the front restraint system are slideably mounted on the standards for movement toward the base and spaced from the backwall. In one embodiment of the invention, the engaging members are U-shaped members that receive the standards in the groove between the outer legs of the U-shaped member. The front restraint slides toward the base moving the sheet engaging surface into engagement with the outermost sheet of the stacked sheets. The stacked sheets being supported on their end tilted toward the backwall. During shipment the transportation forces vibrate the rack resulting in the sheets being further compacted and the front restraint sliding further downwardly toward the base applying or maintaining the forces against the sheets to maintain the sheets as a unitized pack.

The invention still further relates to a method of loading sheets on rack using the front restraint system of the instant invention.

DETAILED DESCRIPTION OF THE INVENTION

The front restraint of the invention will be discussed for securing glass sheets on a rack; however, as will be appreciated the use of the front restraint of the invention is not limited thereto and may be used to secure sheets of any material in a rack.

Figure 1:
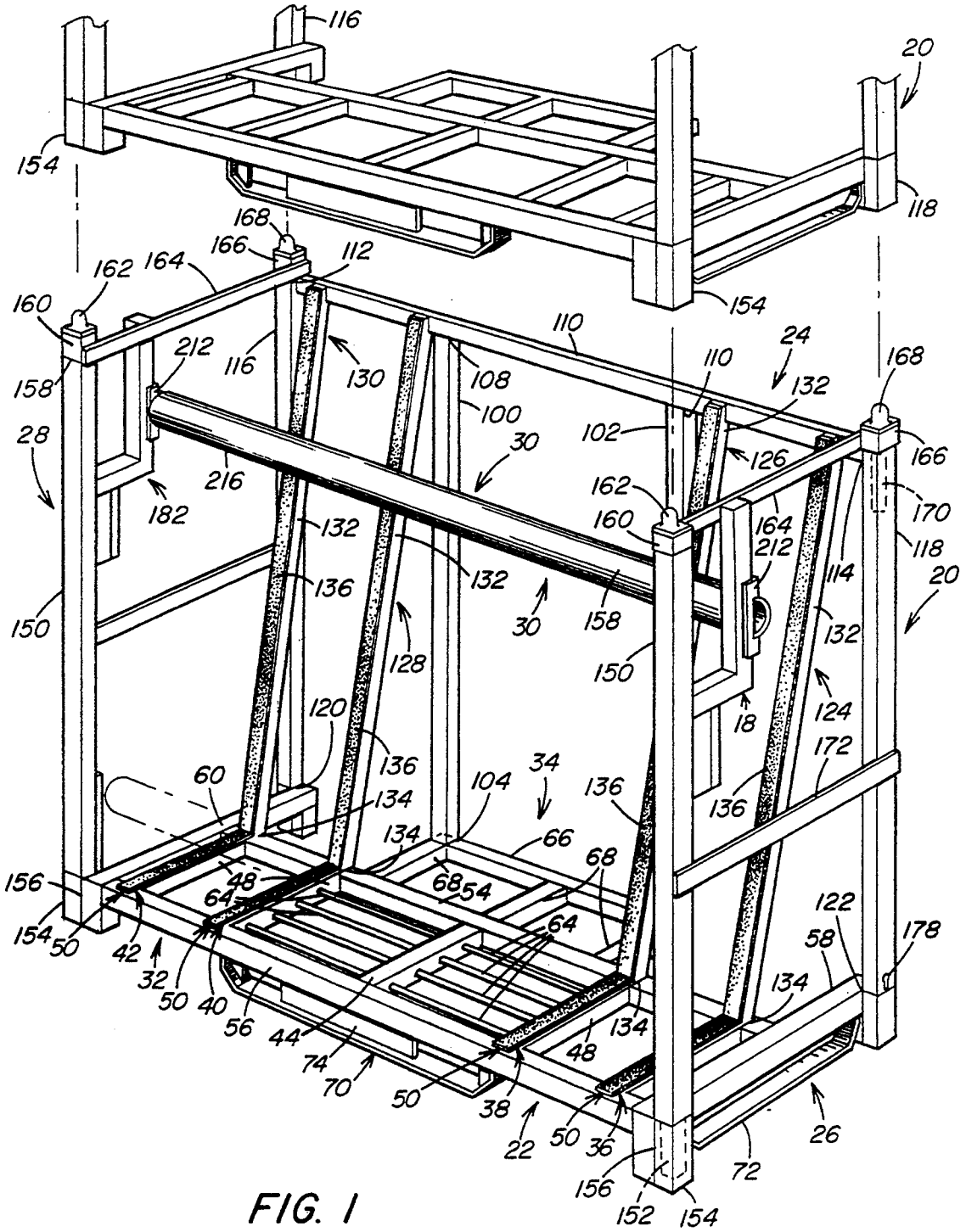
FIG. 1 is an isometric view of a shipping rack of the invention and partial view of the base of another rack to illustrate the stacking features of the rack.

In the following discussion like numerals refer to like elements unless indicated otherwise. With reference to FIG. 1, there is shown rack 20 incorporating features of the invention. The rack 20 includes a base 22, a backwall 24, sidewalls 26 and 28, and front restraint 30. As will be appreciated the front restraint 30 of the invention may be used with any rack design, and the rack 20 to be discussed is not limiting to the invention.

Figure 2:
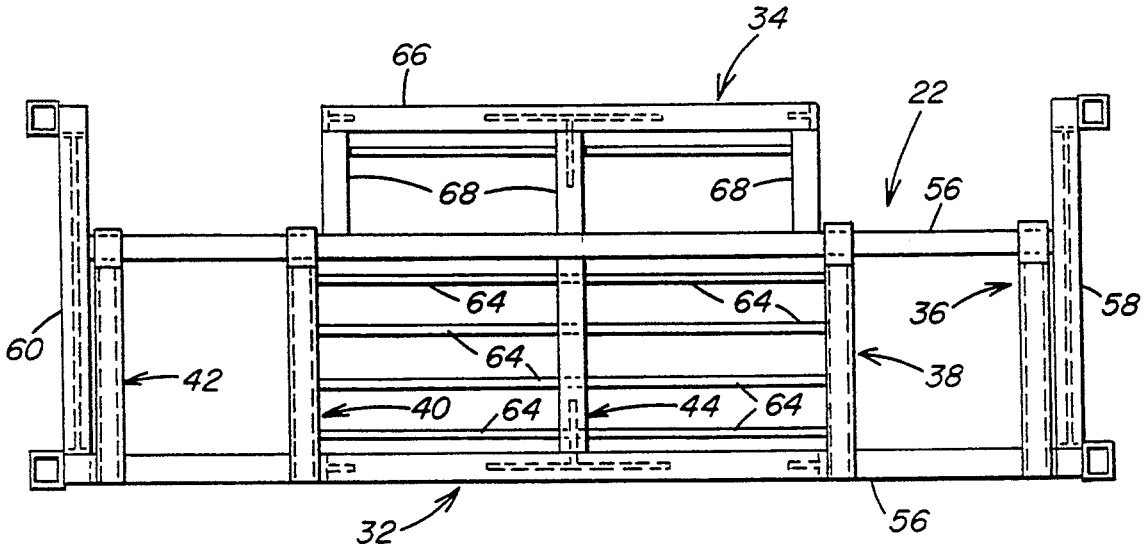
FIG. 2 is a top elevated view of the base of the shipping rack shown in FIG. 1.

Referring now to FIGS. 1 and 2, the base 22 includes sheet support section 32 and rack stabilizing section 34. The sheet support section 32 includes 4 setting pads 36, 38, 40 and 42 and a base bar 44 between the setting pads 38 and 40.

Figure 3:
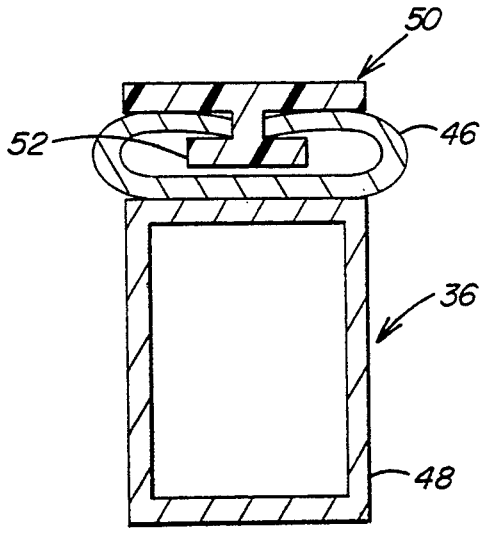
FIG. 3 is a cross sectional view of a setting pad of the base of the rack shown in FIG. 1.

The setting pads 36, 38, 40 and 42 are identical in construction with setting pad 36 shown in FIG. 3. Each of the setting pads includes a C-shaped channel 46 mounted on a cross strut 48 and a resilient member 50 e.g. rubber strip captured in the channel 46 in any manner e.g. the member 50 was secured in the channel 46 by inserting inverted "T" shaped member 52 of member 50 in the C-shaped channel 46 as shown in FIG. 3. Referring back to FIG. 1 the ends of the cross struts 48 of the setting pads 36, 38, 40 and 42 and base bar 44 are secured to rear strut 54 and front strut 56. The ends of the front and rear struts 54 and 56, as clearly shown in FIG. 2 are joined to outer end struts 58 and 60. The outer end struts 58 and 60 have a length sufficient to cooperate with the rack stabilizing section 34 to provide rack stability while defining the depth of the rack. The material and construction of the sheet support section 32 of the base 22 are not limiting to the invention. In the practice of the invention, the base bar 44, cross struts 48 and struts 52, 54, 56 and 58 were made of 2 inch × 2 inch (5.08 centimeters × 5.08 centimeters), ⅛ inch (0.32 centimeter) thick hollow steel tubing. The length of the outer end struts 56 and 58 was about 30 inches (76.2 centimeters), the length of the base bar 44 and cross struts 48 of the setting pads 36, 38, 40 and 42 was about 18 inches (45.72 centimeters) and the length of the front and rear struts 52 and 54, respectively, was about 92 inches (2.3 meters). The resilient members 50 of the setting pads 36, 38, 40 and 42 prevent damage to the edge of glass sheets 62 supported thereon as shown in phantom in FIG. 4. To provide additional stability to the base 22 there were four ½ inch (1.27 centimeters) diameter steel rods 64 welded between the setting pads 38 and 40 and base bar 44 as shown in FIGS. 1 and 2.

With continued reference to FIGS. 1 and 2, the rack stabilizing section 34 of the base 22 includes an outer strut 66 joined to the sheet support section 32 of the base 22 by three spaced cross struts 68. The outer strut 66 and cross strut 68 were made of 2 inch × 2 inch (5.08 centimeters × 5.08 centimeters), ⅛ inch (0.32 centimeter) thick hollow steel tubing. The members 68 had a length of about 8 inches (20.32 centimeters) and the outer strut 66 had a length of about 60 inches (1.5 meters).

The base 22 was supported above the floor by a base support 70 under the front strut 56 at the front of rack 20, a base support (not shown) under the rear strut 54, a base support 72 under the outer end strut 58 and a base support (not shown) under the outer end strut 60. The base supports 66 and 68 and those not shown were made of ½ inch (1.27 centimeters) thick, 3 inch (7.62 centimeters) wide steel strip shaped to the configuration shown in FIG. 1. A steel plate 74 one inch (2.54 centimeters) thick is provided between the front strut 54 and base support 70 and rear strut 52 and underlying base support (not shown) to prevent center bowing of the base 22.

The backwall 24 includes a pair of spaced vertical standard 100 and 102 with end 104 of the standard 100 and end (not shown) of the standard 102 secured to the outer strut 66 and the ends 106 and 108 of the standards 100 and 102, respectively secured to cross strut 110. The cross strut 110 has its ends secured at 112 and 114 to ends of standards 116 and 118. Opposite ends of the standards 116 and 118 are secured at 120 and 122 to the outer end struts 60 and 58 respectively. In the practice of the invention the height of the standards 116 and 118 was about 7 feet (2.1 meters). To support the sheets 62 on their ends and tilted off the vertical, the backwall 24 included support members 124, 126, 128 and 130 each including an elongated member 132 having one end secured at 134 to the rear strut 54 adjacent the juncture of the cross struts 48 of the setting pads 36, 38, 40 and 42 and the rear strut 54. The other end of the member 132 of the support members 124, 126, 128 and 130 are secured to the cross strut 110. The elongated member 132 of the support members 124, 126, 128 and 130 are provided with a resilient member 136 in a similar manner as the setting pad 36 is provided with the resilient member 50 as shown in FIG. 3. The resilient members 136 of the support members 124, 126, 128 and 130 prevent marring of the glass sheet 60 in contact therewith.

Figure 4:
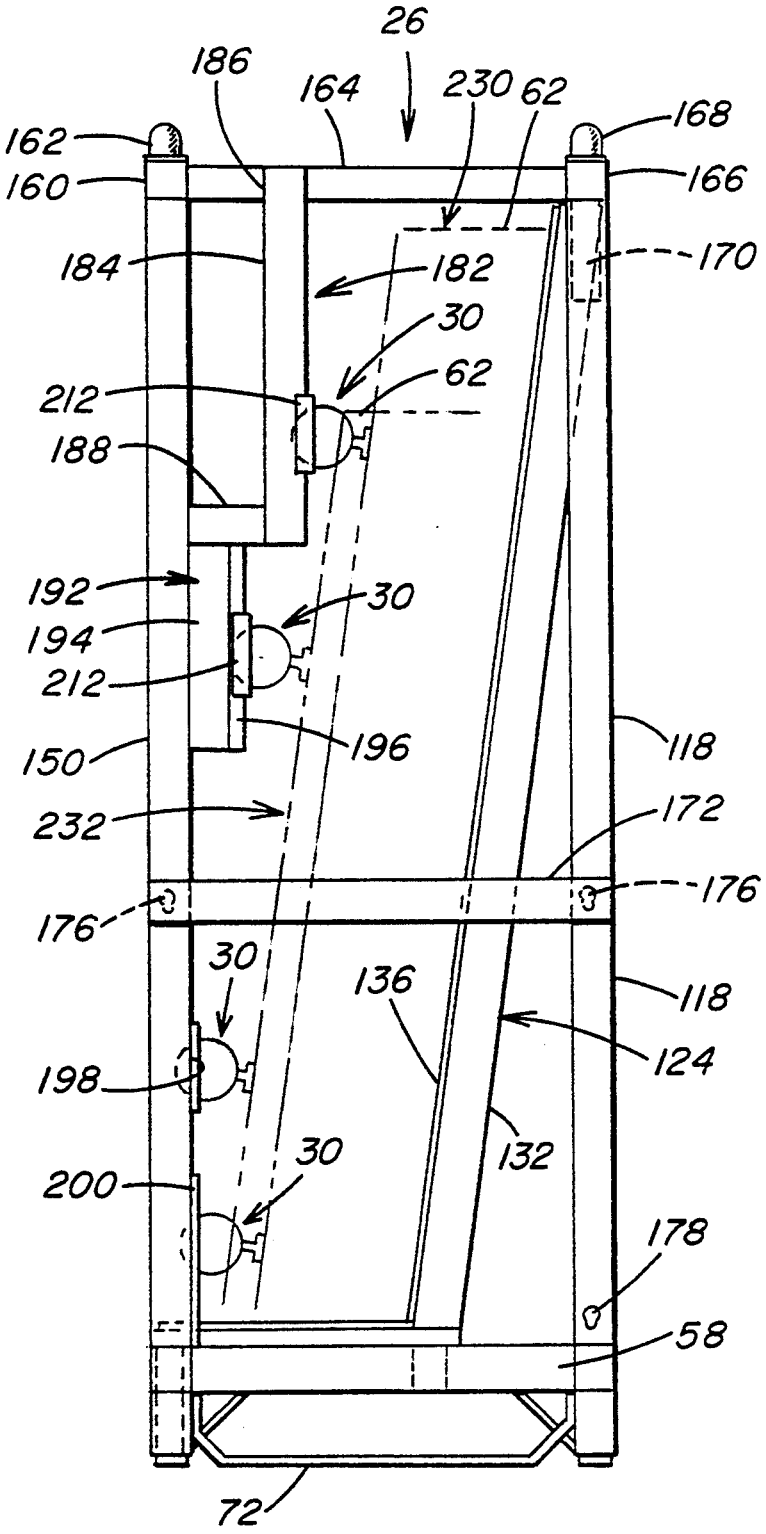
FIG. 4 is a side elevated view of a shipping rack loaded with glass sheets shown in phantom.

With reference to FIGS. 1 and 4, the sidewall 26 will be discussed with the understanding that the discussion directed to the sidewall 26 is applicable to the sidewall 28 unless indicated otherwise. The sidewalls 26 and 28 include the standards 118 and 116 respectively and vertical standard 150 having the end 152 sized to fit into sleeve 154 secured at 156 to each of the outer end struts 58 and 56. The other end 158 of the vertical standard 150 has a collar 160 secured thereto and a pin 162 for stacking racks (to be discussed below). A metal tubing 164 e.g. in the practice of the invention the tubing about ½ inch (1.27 centimeters) thick, about 2 inches (5.08 centimeters) wide and about 30 inches (75 centimeters), has one end secured to the collar 160 and the other end secured to collar 166 detachably secured to the vertical standard 118 at the sidewall 26. At the sidewall 28, the strap 164 is secured to the collar 160 on the standard 150; the collar 166 is detachably secured to the vertical standard 116. Each of the collars 166 has a pin 168 that cooperates with the pins 162 for stacking racking. The collar 166 is detachably secured to its respective standard 116 or 118 by a pin 170 shown in phantom. With this arrangement, lifting the standard 150 removes its end 152 from the sleeve 154 and the collar 166 from the standard 116 or 118, as the case may be. The standard 150 is now rotated by way of the pin 170 about the standard 116 or 118, as the case may be. When the standard 150 has cleared the sidewall area the standard is lowered to move the collar 166 into engagement with the standard 116 or 118, as the case may be. To provide additional support and prevent outward bowing of the standards 150, 116 and 118 there is provided at each sidewall 24 and 26 a metal strip 172 having a rivet 174 at each end which is sized to fit into keyhole 176 provided between the ends of the standards 150, 116 and 118 (see also FIG. 4). The keyhole 176 is not shown for the standards 116. The standards 116 and 118 are further provided with a second keyhole 178 at the lower end for securing the strip 172 (clearly shown in FIG. 8) in position when the rack is being unloaded or returned after the glass sheets have been removed. A rack was made having the standards 150 made of 2 inch (5.08 centimeter) by 2 inch (5.08 centimeter), ⅛ inch (0.32 centimeter) thick hollow steel tubes.

With continued reference to FIG. 1, and with particular reference to FIG. 4, the vertical standard 150 of each of the sidewalls 26 and 28 is provided with an L-shaped member 182 made of 2-inch square tubing having ⅛ inch wall thickness. Leg 184 of the L-shaped member 182 is secured at 186 to the strip 164 and leg 188 at 190 to the standard 150. Below the L-shaped member 182 is a guide 192 made of a 2-inch (5.08 centimeter) square hollow tubing 194 having an ⅛ inch (0.30 centimeter) wall therein secured to the standard 150 and having a shim 196 made of ¼ inch (0.64 centimeter) steel plate secured thereto as shown in FIG. 4. At the lower portion of the standard 150 as viewed in FIG. 4 are provided shims 198 and 200 e.g. shims were made of ¼ inch (0.64 centimeter) steel plate.

Figure 5:
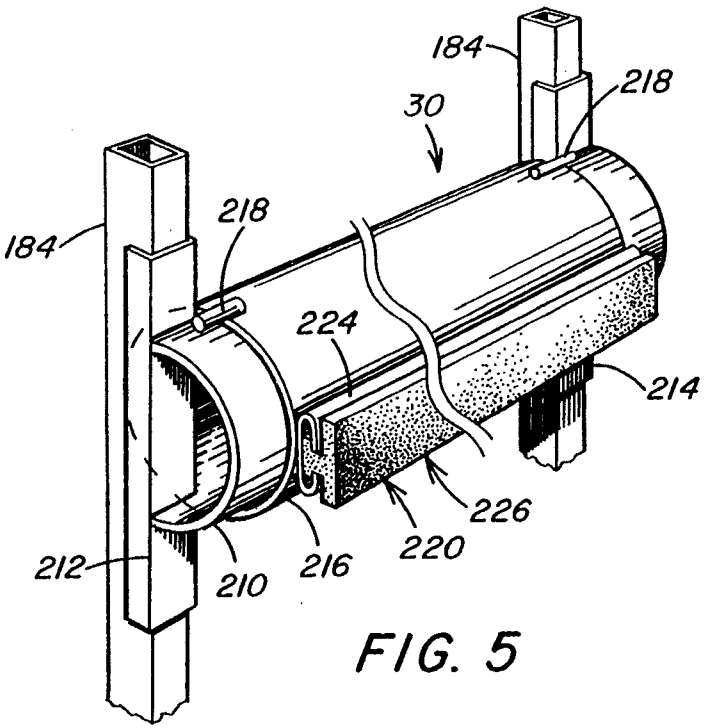
FIG. 5 is an isometric view in sections of the front restraint of the instant invention.
Figure 7:
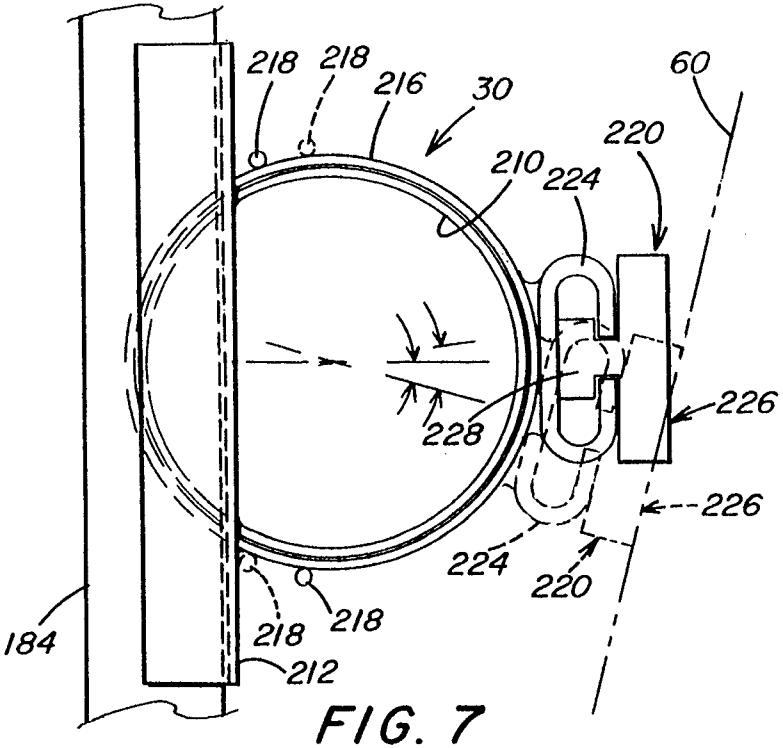
FIG. 7 is a side elevated view of the instant invention showing the end restraint in a non-engaging position and, in dotted lines, in the engaging position.
Figure 6:
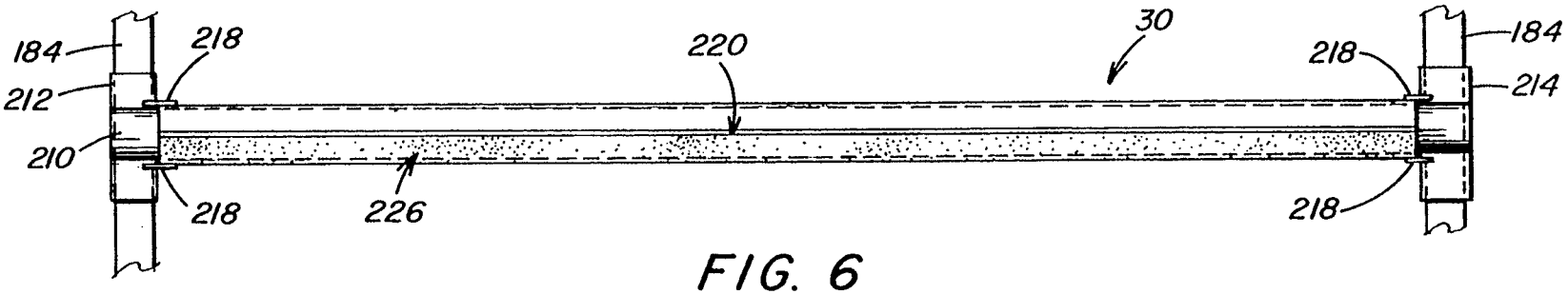
FIG. 6 is a front elevated view of the front restraint of the instant invention.

With reference to FIGS. 5, 6 and 7 the discussion will now be directed to the front restraint 30 of the instant invention. The front restraint 30 includes an inner hollow tube 210 e.g. a tube having a diameter of about 4 inches (10.16 centimeters). Each of the ends of the tube 210 has U-shaped member 212 and 214 e.g. U-shaped members used were 6 inches (15.24 centimeters) in length, had a thickness of about ¼ inch (0.64 centimeter) and had an opening between the legs of the U-shaped member to engage and slide along selected surface portions of the member 184, L-shaped members 182, the shims 196 of the guide 192, the shims 198 and 200 as shown in FIG. 4. The U-shaped members 212 and 214 are secured to the ends of the inner hollow tube 210 in any convenient manner. An outer circular elongated member 216 having an inner diameter of about 4¼ inches (10.8 centimeters) and a wall thickness of about ⅛ inch (0.32 centimeters) receives the inner hollow tube 210 and is rotatable about the tube 210. The tube 210 used had a length of about 70 inches (1.78 meters) and the inner tube 216 used had a length of about 65 inches (1.66 meters). As shown in FIGS. 5–7, the inner tube 216 is provided with a pair of stop pins 218 at each end which extend therefrom to engage the respective U-shaped members 212 and 214. The stop pins 218 engage the U-shaped members 212 and 214 to limit the rotation of the outer tube 216 so that the sheet engaging member 220 is in position to engage the outermost sheet 60 of the sheet stack and adjust to the slope of the stack as shown in FIGS. 4 and 7. In the practice of the invention the pins 218 at the ends were spaced from one another to allow the outer tube 206 to rotate about ±5° about the coincidental axis 220 of the tubes 210 and 216 as shown in FIG. 7. With specific reference to FIGS. 5 and 7, the sheet engaging member 220 includes an elongated C-shaped channel 224 secured to the outer tube 216. A resilient member 226 having a T-shaped side 228 is positioned in the C-shaped channel 224 to secure the resilient member in position.

With reference to FIG. 1, the discussion will now be directed to loading the rack with glass sheets 60 and maintaining the sheets 60 as a unitized pack in the rack 20 during shipment using the front restraint 30 of the invention.

The rack 20 is loaded by removing, if not already removed, the sidewalls 26 and 28 by rotating the standards 150 and strap 164 about the standards 116 and 118 to position the standard 150 to the side or behind the rack. The glass sheets 60 are positioned by setting the edges of the sheets on the setting pads 36, 38, 40 and 42 of the base 22 and tilting the sheets to rest on the support members 124, 126, 128 and 130 of the backwall 26. With reference to FIG. 4 the rack 20 in this example is loaded with glass sheets 62 to form the stack 230. The sheets stacked were about 72 inches (1.8 meters) high and about 84 inches (2.1 meters) wide. After the sheet stack 230 was formed, the sidewalls 26 and 28 were put in position by rotating the standards 150 and strip 164 about the standard 116 and 118 and inserting end 152 of the standards 150 in the sleeve member 154. For ease of handling the vertical standard 150 and strap 164, the pin 170 is maintained in its respective standard 116 and 118 and the standard 150 and the strap 164 are rotated about the respective standard 116 and 118. Thereafter the rivets 174 of the strap 172 are mounted in keyholes 176 of the standard 150 and 118 (see FIGS. 4 and 8). The U-shaped members 212 of the front restraint 30 were positioned on the member 184 of the L-shaped member 182 as shown in FIG. 4. Although not used in the practice of the invention, but if desired, the U-shaped member 212 of another front restraint 30 may be mounted on the shims 200 as shown in FIG. 4.

The invention was practiced loading glass sheets 62 having a height 60 inches (1.5 meters) and a width of 84 inches (2.1 meters) to form the stack 232. In this instance, the U-shaped members 212 of the front restraint 30 were positioned on shims 196 as shown in FIG. 4. Although not limiting to the invention, the U-shaped member 212 of a front restraint 30 may be mounted on the shim 198 as shown in FIG. 4.

After a rack is loaded, it may be stacked on top of another rack by inserting the sleeves 154 and the bottom end of the standards 116 and 118 on the pins 162 and 168 respectively of the lower rack as shown in FIG. 1.

During shipment as the racks and sheets therein are vibrated by the transportation forces, the front restraint 30 slides downwardly toward the base 22 as shown in FIG. 4 to constantly maintain the resilient member 226 in engagement with the outermost sheet 60 of the stack 230 or 232, to apply a force to the sheets to unitize the pack of sheets.

To unload the rack, a single rack is positioned on the floor. The front restraint 30 is removed by urging it upwardly as viewed in FIG. 4 to disengage the sheets, and thereafter the U-shaped members 212 of the front restraint 30 disengage the sidewalls 26 and 28. The metal strap 172 is removed from the sidewalls and mounted in the keyholes 176 and 178 in the standards 116 and 118 (see FIG. 4). Thereafter the standard 150 is lifted and rotated by way of the pins 170 about the standards 116 and 118, respectively and dropped so that the collar 166 engages the standard 116 or 118, respectively, to secure the standard 150 in position. Thereafter the sheets are removed.

Figure 8:
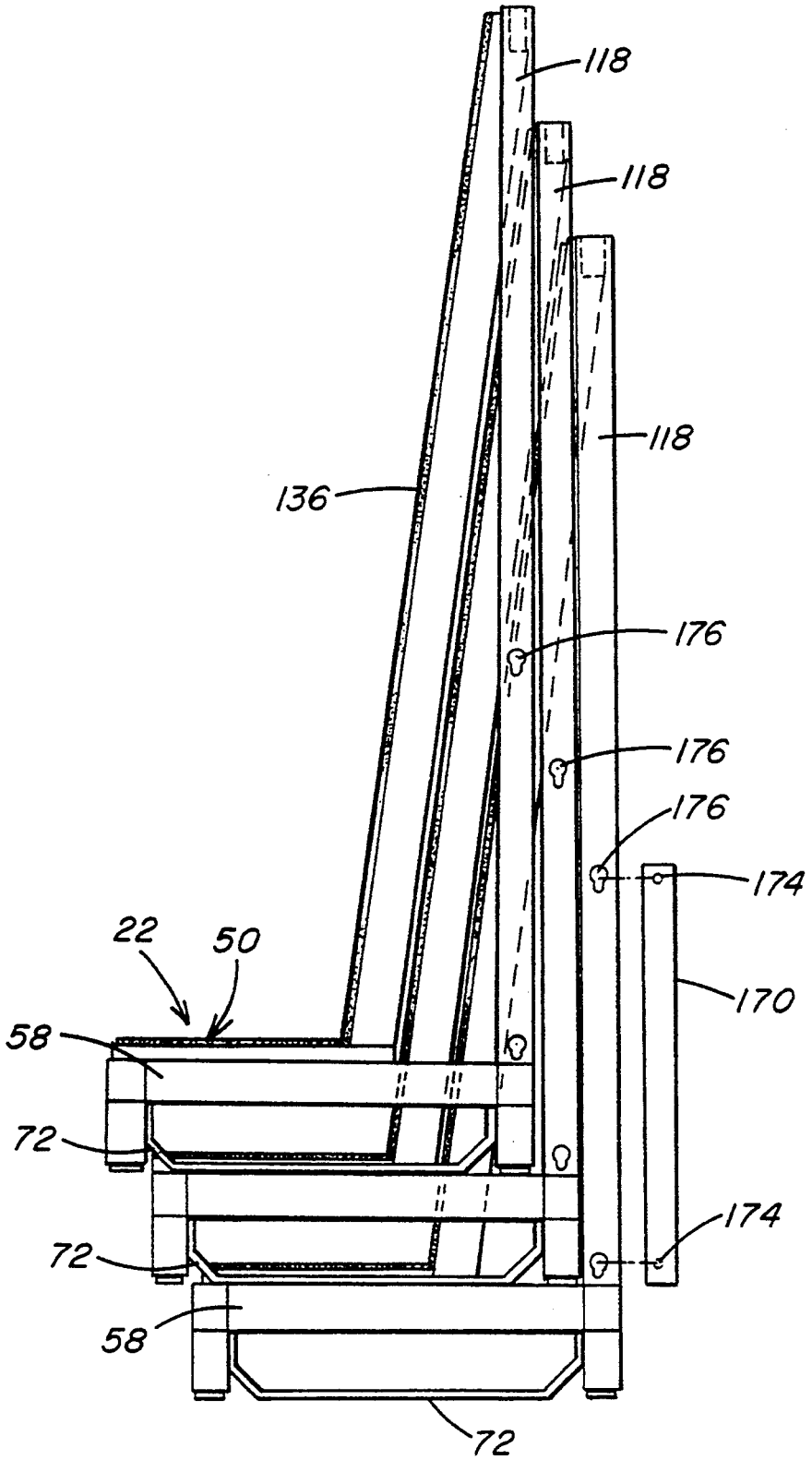
FIG. 8 is a side elevated view of the stacked racks of the type of the instant invention.

After the racks are unloaded they may be stacked as shown in FIG. 8. The front restraints 30 and standards 150 of sidewalls 26 and 28 are layed on the base 22 of the uppermost stacked rack, and the stacked racks, front restraints and standards 150 are banded together for return shipment.

As will be appreciated the invention is not limited to the design and construction of the rack built and modifications can be made thereto without deviating from the scope of the invention.

What is claimed is:

1. In a sheet shipping rack of the type having a base, and a backwall secured to the base, to maintain the sheets on edge in a vertical position, and a front restraint for securing the sheets in position urged toward the backwall, wherein the improvement comprises:

the front restraint comprising:

an elongated member;

a hollow member mounted on said elongated member and sized to allow the hollow member to rotate about the elongated member;

sheet engaging means secured to the hollow member; and means for mounting the elongated member spaced from the backwall and movable toward the base.

2. The shipping rack of claim 1 wherein said mounting means includes:

a pair of vertical standards mounted on the base in spaced relationship to one another and the backwall; and a U-shaped member mounted on each end of the elongated member for receiving in the groove of the U-shaped member a respective one of the vertical standards.

3. The shipping rack of claim 2 wherein the sheet engaging means includes an elongated resilient sheet engaging member.

4. The shipping rack of claim 3 wherein the front restraint includes at least one pin at each end of the hollow member and extending away from the end of the elongated member and engageable with the adjacent U-shaped member.

5. The shipping rack of claim 2 wherein each of the vertical standards have vertical and horizontal struts joined together to form a generally "L-shaped" member cooperating with its respective vertical standard to provide a surface between the standard and the backwall for engagement by the U-shaped members.

6. The shipping rack of claim 1 wherein the front restraint includes a standard having an end detachably mounted in the base and a horizontal member having one end secured to the standard and the other end detachably mounted to the backwall to provide a sidewall and for the standard to be rotated about the backwall.

7. The shipping rack of claim 4 wherein the at least one pin includes a pair of spaced pins at each end of the hollow member and engageable with adjacent U-shaped member to limit rotation of the hollow member relative to the elongated member.

8. The shipping rack of claim 7 wherein the rotation is limited to about 10°.

9. The shipping rack of claim 7 wherein the elongated member is a first hollow elongated tube and the hollow member is a second hollow elongated tube wherein the axis of the first and second tubes are coincidental and the sheet engaging member is maintained by the pins in position to align the with the sheet engaging member sheets to be loaded on the rack.

10. A restraint for a sheet shipping rack comprising:

a first elongated circular member;

a hollow second elongated circular member mounted on and rotatable about the first elongated member;

surface engaging member mounting on each of the ends of the first member and extending beyond the outer surface of said first member to capture the second member on the first member while permitting the first and second members to rotate relative to one another;

a sheet engaging member mounted on the second member.

11. The restraint of claim 10 wherein the first member is a hollow member, the surface engaging members are U-shaped members and the longitudinal axis of the first and second members are coincidental.

12. The restraint of claim 11 further includes at least one pin secured to each end of the second member and extending beyond the end of the second member to engage the adjacent U-shaped member so that rotation of the tubes is limited by the pins engaging its respective one of the U-shaped member.

13. The restraint of claim 12 wherein the at least one pin at each end of the second member are a pair of spaced pins at end of the second member.

14. The restraint of claim 12 wherein the second member rotates through a 10° angle.

15. The front restraint of claim 14 wherein the sheet engaging member includes an elongated channel having a C-shaped cross section secured to the second member with the groove of the channel facing away from the second member and a rubber member having a T-shaped surface mounted in the C-shaped channel.

16. In a method of loading sheets on rack of the type having a base, a backwall secured to the base and sidewalls secured to the base and backwall, wherein the method includes the steps of mounting the sheets on edge on the base supported by the backwall in a generally vertical position and securing the sheets in the rack, the improvement comprising:

the securing step comprising the steps of:

providing a front restraint having a first hollow elongated member mounted on second elongated member with the first hollow member rotatable relative to the second member;

mounting the ends of the second elongated member to the sidewalls;

sliding the front restraint toward the base to move the first member into engagement with the outermost sheet.

17. The method of claim 16 wherein the sheets are glass sheets and the plane of the backwall is at an angle to the plane of the base so that the sheets are at an angle to the vertical, said providing step includes mounting an elongated resilient member on said first member.

18. The method of claim 17 further including the step of limiting rotating of the first member so that the resilient member is in engagement with the outermost sheet during the practice of the securing step.

19. The method of claim 18 wherein said securing step includes moving the front restraint by the force of gravity toward the base to move the resilient member into engagement with the outermost sheet.

20. The shipping rack of claim 6, wherein the sidewall further includes a strip having one end detachably secured to the standard and the other end, of the strip detachably secured to the backwall, and the backwall further including means cooperating with the strip for detachably securing the strip to the backwall.

* * * * *

UNITED STATES PATENT AND TRADEMARK OFFICE

CERTIFICATE OF CORRECTION

PATENT NO. : 5,379,904
DATED : January 10, 1995
INVENTOR(S) : William J. Brown

It is certified that error appears in the above-indentified patent and that said Letters Patent is hereby corrected as shown below:

Column 7, claim 9, line 6, after first occurrence of "the", delete "with the"; after "member", add --with the--.

Column 8, claim 20, line 3, after "end", delete ",".

Signed and Sealed this

Twenty-seventh Day of June, 1995

*Attest:*

Bruce Lehman

BRUCE LEHMAN

*Attesting Officer*

*Commissioner of Patents and Trademarks*